US009777936B2

(12) United States Patent
Massimino

(10) Patent No.: US 9,777,936 B2
(45) Date of Patent: Oct. 3, 2017

(54) AIR DESTRATIFIER FOR SPACES

(75) Inventor: Gianpiero Massimino, Savigliano (IT)

(73) Assignee: C.G.M. S.R.L., Cuneo (IT)

( * ) Notice: Subject to any disclaimer, the term of this patent is extended or adjusted under 35 U.S.C. 154(b) by 266 days.

(21) Appl. No.: 12/999,222

(22) PCT Filed: Feb. 18, 2009

(86) PCT No.: PCT/IB2009/050655

§ 371 (c)(1),
(2), (4) Date: Dec. 15, 2010

(87) PCT Pub. No.: WO2009/153673

PCT Pub. Date: Dec. 23, 2009

(65) Prior Publication Data

US 2011/0111687 A1 May 12, 2011

(30) Foreign Application Priority Data

Jun. 16, 2008 (IT) ..... TO2008A0468

(51) Int. Cl.
*F24F 7/06* (2006.01)
*F24F 7/007* (2006.01)

(52) U.S. Cl.
CPC ..... *F24F 7/065* (2013.01); *F24F 7/007* (2013.01)

(58) Field of Classification Search
CPC ..... F24F 7/06; F24F 7/065
USPC ..... 454/231, 247, 249
See application file for complete search history.

(56) References Cited

U.S. PATENT DOCUMENTS 1,170,551 A * 2/1916 Marty ..... F24F 7/065 237/46
1,958,768 A * 5/1934 Ross ..... 55/472
3,173,353 A * 3/1965 Watkins ..... F24D 5/00 236/49.3
3,561,345 A * 2/1971 Kline et al. ..... 454/267
3,827,342 A * 8/1974 Hughes ..... 454/231
4,152,973 A * 5/1979 Peterson ..... F24F 7/065 454/231
4,185,545 A * 1/1980 Rusth et al. ..... 454/231
(Continued)

FOREIGN PATENT DOCUMENTS

DE 20008215 U1 8/2000
DE 20204487 U1 7/2002
(Continued)

OTHER PUBLICATIONS

Translation Portal.epo.org Eisenfuhr (DE 2006 009501 U1), Nov. 2007 Heating, cool and air circulation device for stable building.*
(Continued)

*Primary Examiner* — Steven B McAllister
*Assistant Examiner* — Frances F Hamilton
(74) *Attorney, Agent, or Firm* — Sughrue Mion, PLLC

(57) ABSTRACT

The air destratifier comprises: a casing (10), an intake tube (26) connected to the casing (10) to draw the air from the upper part of the space where the air destratifier is intended to be installed, and a centrifugal blower with a vertical axis of rotation (23) arranged downstream of the intake tube (26) to dispense to the space the air drawn through the intake tube (26). The air destratifier further comprises an air filter (14) arranged in the casing (10) upstream of the blower.

9 Claims, 2 Drawing Sheets

(56) References Cited

Figure 1:
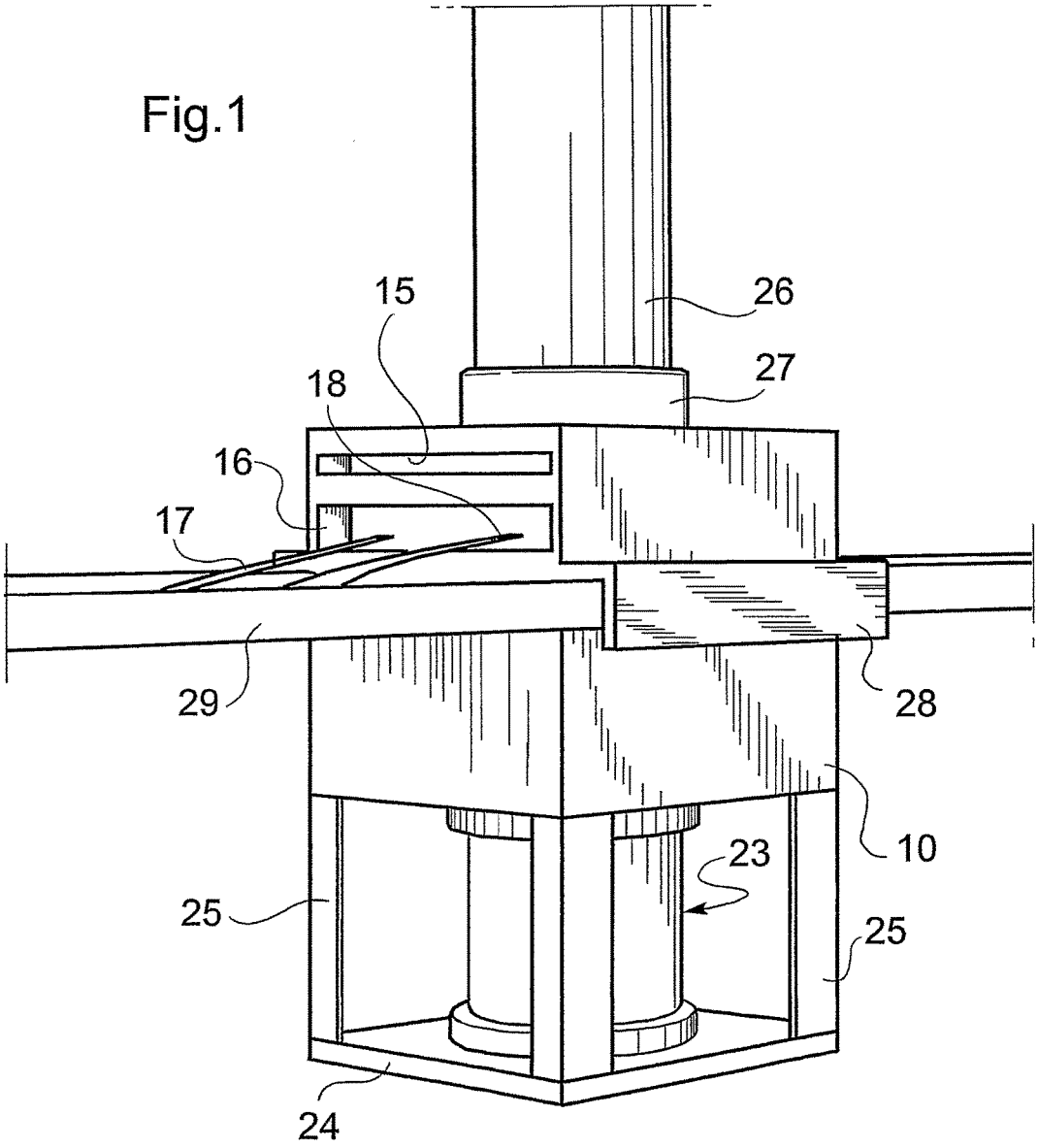

U.S. PATENT DOCUMENTS 4,222,318 A * 9/1980 Patton ..... F04D 25/08 248/126
4,255,176 A * 3/1981 Macrow ..... 55/415
4,287,872 A * 9/1981 Rampe ..... 126/110 D
4,526,592 A * 7/1985 Armbruster ..... 96/121
4,681,064 A * 7/1987 Lilliston, Sr. ..... A01K 1/0052 119/448
4,849,862 A * 7/1989 Diskin et al. ..... 362/96
5,042,366 A * 8/1991 Panetski et al. ..... 454/231
5,240,478 A * 8/1993 Messina ..... 95/273
5,332,373 A * 7/1994 Schendel ..... F04D 29/628 417/360
5,348,447 A * 9/1994 Redetzke ..... F04D 29/703 416/247 R
5,680,672 A * 10/1997 Baumann ..... F04D 25/105 15/301
5,749,702 A * 5/1998 Datta et al. ..... 415/119
6,004,365 A * 12/1999 Fiacco ..... 55/400
6,322,614 B1 * 11/2001 Tillmans ..... 96/16
6,336,793 B1 * 1/2002 Litvin ..... F04D 29/601 248/126
6,361,431 B1 * 3/2002 Kawano ..... F24F 7/007 454/189
6,372,005 B1 * 4/2002 Fiacco ..... 55/400
6,402,612 B2 * 6/2002 Akhtar et al. ..... 454/186
6,514,304 B2 * 2/2003 Fiacco ..... 55/400
6,644,300 B1 * 11/2003 Toribio ..... 126/110 B
6,712,690 B1 * 3/2004 Wipf ..... A01K 1/0052 119/448
6,866,480 B2 * 3/2005 Canali et al. ..... 415/212.1
7,467,931 B2 * 12/2008 O'Toole ..... F04D 25/088 415/220
7,670,400 B2 * 3/2010 Reynolds et al. ..... 55/473
8,133,009 B2 * 3/2012 Salvesen ..... 415/118
8,167,542 B1 * 5/2012 Owusu ..... 415/127
2005/0017110 A1 * 1/2005 Johnson ..... B02C 13/1807 241/275
2008/0200113 A1 * 8/2008 Munn et al. ..... 454/341
2013/0224043 A1 * 8/2013 Risser ..... F04D 17/105 417/53

FOREIGN PATENT DOCUMENTS

DE 202006009501 U1 * 10/2007 ..... A01K 1/0047
DE 202006009501 U1 11/2007
FR 826255 A 3/1938
GB 2029002 A * 3/1980 ..... F24F 13/06
JP 54154148 A * 12/1979
JP 3-050433 A 3/1991

OTHER PUBLICATIONS

The American Society of Heating, Refrigerating and Air Conditioning Engineers, 2008 ASHRAE Handbook—HVAC Systems and Equipment (SI), Chapter 20: Fans, pp. 1 and 2.*

International Search Report for International Application No. PCT/182009/050655 dated Jul. 2, 2009.

* cited by examiner

AIR DESTRATIFIER FOR SPACES

The present invention refers to an air destratifier for spaces, in particular, but not exclusively, industrial and zootechnical spaces.

An air destratifier is a device which is commonly used, particularly in industrial and zootechnical spaces, to draw the hot air accumulating in the upper zones of those spaces and to convey it towards the lower zones, so as to improve the efficiency of the heating apparatus of those spaces. An air destratifier typically comprises a casing, for instance a sheet metal casing, an intake tube connected to the casing and extending upwards to draw the hot air from the high layers of the space where the air destratifier is to be installed, and a blower for diffusing downwards in the space the hot air drawn through the intake tube. An air/water heat exchanger or heat exchange battery (typically of the finned type) may also be provided inside the casing of the air destratifier to transfer heat to the air drawn through the intake tube and hence to perform also the function of a fan coil for heating the space by convection. The air destratifier may also be provided with an air filter to retain dust and dirt in general dispersed in the air drawn through the intake tube, the air filter being particularly useful in case of an air destratifier operating also as a fan coil to prevent dust and dirt from rapidly leading to clogging of the heat exchanger, particularly when the air destratifier is installed in a particularly dusty space.

The current air destratifiers are provided with axial blowers, which are not capable of generating a pressure increase (head) sufficiently high to ensure good performances in terms of drawing the hot air from the high layers of the industrial and zootechnical spaces and of diffusing the air at a small height form the ground, even more where an air filter and/or a heat exchanger are provided, which inevitably produce pressure losses. The use of an axial blower arranged with its own axis oriented vertically further requires the adoption of fences serving to deviate the direction of the air flow generated by the impeller of the blower from an axial one to a radial one, so as to obtain an air flow leaving the air destratifier with an essentially horizontal direction and hence not hitting directly on the persons and/or the animals present in the space in which the air destratifier is installed. However, the deflection of the air flow leaving the impeller of the axial blower by the fences involves a further pressure loss and hence a reduction in the overall efficiency of the air destratifier.

It is therefore an object of the present invention to provide an air destratifier having a blower capable of generating a pressure increase sufficiently high to make it possible to redistribute efficiently the hot air in the space, even in case an air filter and/or a heat exchanger are provided.

This and other objects are fully achieved according to the present invention by virtue of an air destratifier having the features set forth in the enclosed independent claim 1.

Further advantageous features of the air destratifier according to the present invention are set forth in the dependent claims, the content of which is to be intended as integrating and integral part of the present description.

Figure 2:
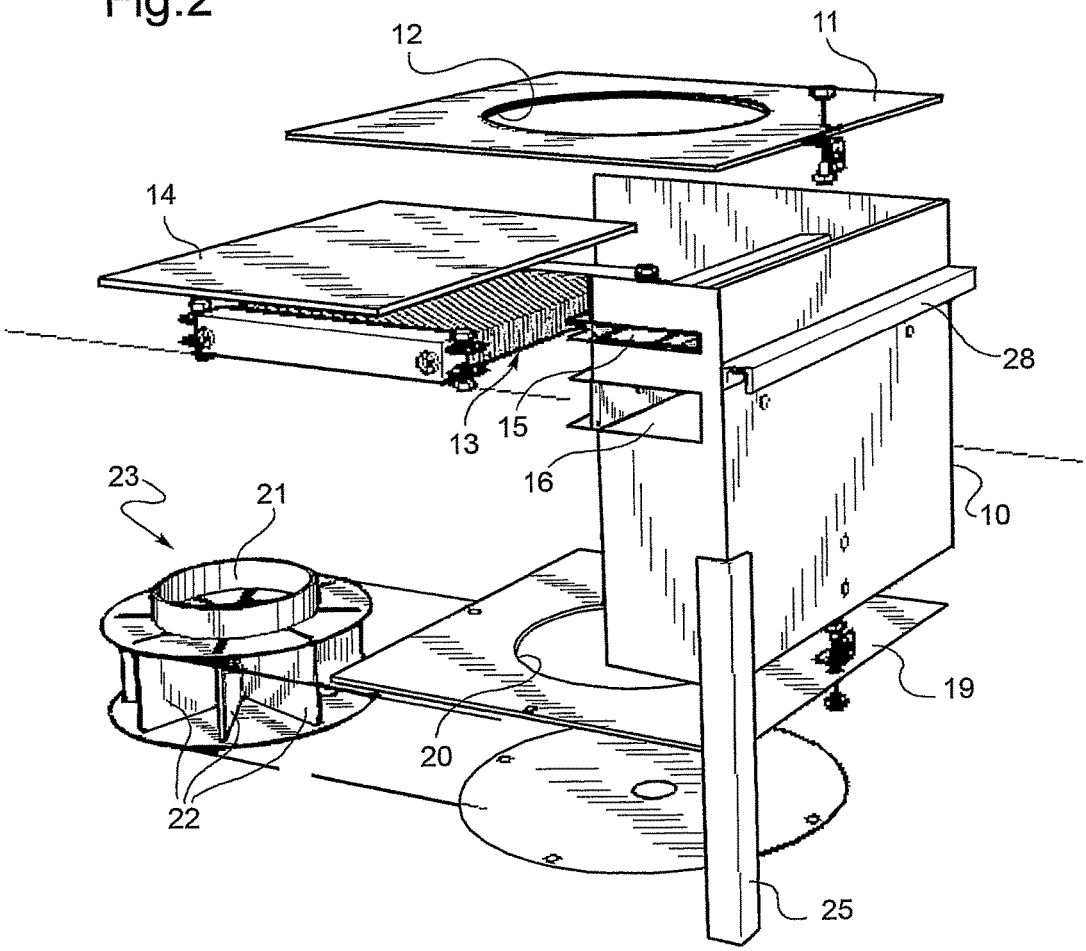

The features and advantages of the present invention will clearly result from the following detailed description, given purely by way of non-limiting example with reference to the appended drawings, in which:

FIG. 1 is an overall perspective view of an air destratifier according to a preferred embodiment of the present invention; and FIG. 2 is an exploded perspective view of components of the air destratifier of FIG. 1, some of which are illustrated in partially cut-away view.

With reference to the drawings, an air destratifier according to the present invention comprises an outer casing 10, preferably of sheet metal, with an upper horizontal wall 11 having an opening 12 through which hot air is drawn from the upper part of the space where the air destratifier is installed. In the illustrated embodiment, in which the air destratifier acts also as a fan coil, at least one air/water heat exchanger or heat exchange battery, wholly indicated 13, is accommodated inside the casing 10. The heat exchanger 13 is known in the art and need not be described in detail. It is hereby sufficient to remind that, due to the reasons which will be explained further on, one may conveniently choose a heat exchanger with particularly thick fins, with positive consequences on the thermal efficiency of the air destratifier. Obviously, where it is not also required to heat the air drawn from the high layers of the space, but it is only sufficient to redistribute the hot air, the heat exchanger may be omitted.

Between the opening 12 and the heat exchanger 13 there is interposed an air filter 14 in the shape of a horizontal member which can be pulled out through a slit 15 provided in a side wall of the casing 10. The casing 10 also has a second side opening 16 through which water supply and return conduits 17 and 18 of the heat exchanger 13 can pass. At its bottom the casing 10 comprises a horizontal wall 19, which has a central opening 20 communicating with the inlet 21 of the impeller 23 of a centrifugal blower which has a vertical axis of rotation and is operated by an electric motor known per se and not illustrated.

In the illustrated embodiment, the impeller 23 of the centrifugal blower has purely radial and straight blades 22, but the invention also comprises centrifugal blowers with impellers having blades of shapes different from the one illustrated herein, for instance straight but not radial blades, curved blades with radial outlet, concave blades (i.e. blades the outlet of which is directed in the same direction as the peripheral velocity) or convex blades (i.e. blades the outlet of which is directed in the opposite direction to the peripheral velocity). Throughout the following description and claims, terms and expressions such as "upstream" and "downstream" are to be intended as referred to the direction followed by the air flow generated by the rotation of the impeller of the blower. Likewise, expressions indicating positions and orientations, such as "radial", "transverse" and "tangential", are to be intended as referred to the axis of rotation of the blower.

The impeller is supported by a support base 24 (FIG. 1) connected to the casing 10 but spaced therefrom by means of four struts 25, in such a manner that the impeller 23 can diffuse air directly through 360° in the surrounding environment.

The air destratifier operates as follows. As a result of the rotation about its own vertical axis, the impeller 23 of the centrifugal blower draws the air from the top of the space through a serrated intake hose 26 which connects an upper intake mouth 27 of the casing 10 with the upper zone of the space, if possible just below the ceiling or the roof. The air drawn from that zone of the space, which has on average a higher temperature than the lower zone of the space itself, enters the casing 10 through the upper opening 12, is filtered by the air filter 14, if any, and is taken in by the blower passing through the heat exchange battery 13, if any, which exchanges heat by forced convection with the hot water flowing in the finned tubes of the battery.

A centrifugal blower such as the one provided in the air destratifier according to the present invention is capable of producing a pressure increase (head) of several hundreds of Pascal (for instance 600 Pa), hence an increase far higher than that of an axial blower traditionally used in the known air destratifiers. This makes it possible to obtain a more efficient operation, even when an air filter and/or a heat exchange battery are provided. Moreover, in case of an air destratifier operating also as a fan coil it is possible to use a heat exchanger having particularly thick fins, which results in a very high thermal efficiency. The high head of the centrifugal blower used in the air destratifier according to the present invention also allows to place the air destratifier at a low height from the ground (for instance 2 m), even though the air is drawn at a great height (even of several meters, for instance 5-10 m), so as to perform an efficient redistribution of the hot air from the high layers to the low layers of the space to be heated.

With an air destratifier according to the present invention the air is delivered by the blower in the surrounding environment in a diffused manner in substantially radial or tangential directions, or at least in directions transverse to the vertical one, which offers a better comfort with respect to the concentrated flow generated by an axial blower, the output power remaining unchanged. This feature makes the air destratifier of the present invention particularly suitable for being installed for instance in a zootechnical space as well. Naturally, the reference to this possible field of application is not to be construed in any way as limitative of the scope of the patent.

Reference numeral 28 indicates a bracket of a pair of side brackets by means of which the casing of the fan coil can rest on a pair of support bars 29, which can be raised by means of a suitable hoisting apparatus (not illustrated) to allow periodically to clean the pavement of a zootechnical building.

Experimental tests carried out by the Applicant have proved that the choice to use a centrifugal blower for an air destratifier operating also as a depression fan coil makes it possible to obtain excellent results, for instance 4000 $m^3/h$ of air heated with a thermal power of 40 kW, with reduced sizes.

Naturally, the invention is not limited to the embodiment described and illustrated herein, which is to be considered simply as an example of implementation of the air destratifier. The invention is instead susceptible of changes relating to the shape and arrangement of parts, to the details of construction and to the operating characteristics. For instance, the casing may have shapes significantly different from the one illustrated, particularly in the part thereof which are intended to support the impeller of the centrifugal blower.

The invention claimed is:

1. An air destratifier configured to recirculate air inside a closed occupied space by drawing hot air accumulating in an upper part of the closed occupied space and blowing it towards a lower part of the closed occupied space, the air destratifier comprising:

a casing located in the closed occupied space, an intake tube, located in the closed occupied space, connected to the casing, and a blower, located in the closed occupied space, arranged downstream of the intake tube, drawing the air from the upper part of the closed occupied space and dispensing, in the lower part of the closed occupied space, the air drawn through the intake tube;

wherein the blower is a centrifugal blower with a vertical axis of rotation and includes an impeller having blades, wherein the blower is mounted downwardly and outside of the casing, wherein the impeller is supported by a support base connected to, but spaced from, the casing by means of four struts located at respective corners of the support base such that the blades are exposed to the closed occupied space, and wherein the blower dispenses the air to the closed occupied space in substantially radial or tangential directions.

2. Air destratifier according to claim 1, wherein the blades are radial blades or straight blades.

3. Air destratifier according to claim 1, wherein the blades are selected from the following types: straight blades but non-radial, curved blades with radial outlet, concave blades with an outlet directed in the same direction as the peripheral velocity, convex blades with an outlet directed in the opposite direction to the peripheral velocity.

4. Air destratifier according to claim 1, further comprising an air filter arranged upstream of the blower.

5. Air destratifier according to claim 4, wherein the air filter is received in the casing.

6. Air destratifier according to claim 1, further comprising a heat exchanger received in the casing the heat exchanger heating the air drawn from the closed occupied space through the intake tube.

7. Air destratifier according to claim 5, wherein the air filter is arranged upstream of the heat exchanger.

8. Air destratifier according to claim 1, wherein the casing has a top horizontal wall with an opening and wherein the intake tube is connected to the casing by means of said opening.

9. Air destratifier according to claim 1, wherein the blades are not enclosed by a housing.

* * * * *